US009181775B2

(12) United States Patent
Eden

(10) Patent No.: US 9,181,775 B2
(45) Date of Patent: Nov. 10, 2015

(54) SEALING METHOD AND APPARATUS

(75) Inventor: Robert D. Eden, Cheshire (GB)

(73) Assignee: RAWWATER ENGINEERING COMPANY LIMITED, Stockport, Cheshire (GB)

( * ) Notice: Subject to any disclaimer, the term of this patent is extended or adjusted under 35 U.S.C. 154(b) by 625 days.

(21) Appl. No.: 13/514,379

(22) PCT Filed: Dec. 1, 2010

(86) PCT No.: PCT/GB2010/002196
§ 371 (c)(1),
(2), (4) Date: Jun. 7, 2012

(87) PCT Pub. No.: WO2011/073610
PCT Pub. Date: Jun. 23, 2011

(65) Prior Publication Data

US 2012/0298359 A1 Nov. 29, 2012

(30) Foreign Application Priority Data

Dec. 15, 2009 (CA) ..... 2688635
Dec. 15, 2009 (CA) ..... 2688704

(51) Int. Cl.
*E21B 33/00* (2006.01)
*E21B 36/00* (2006.01)
(Continued)

(52) U.S. Cl.
CPC ..... *E21B 33/134* (2013.01); *E21B 33/1204* (2013.01)

(58) Field of Classification Search
CPC .... E21B 33/134; E21B 33/1204; E21B 33/13
USPC ..... 166/57, 277, 285, 288, 387
See application file for complete search history.

(56) References Cited

U.S. PATENT DOCUMENTS 1,631,419 A 7/1927 Kinley
2,191,783 A 2/1940 Wells
(Continued)

FOREIGN PATENT DOCUMENTS

GB 2417266 2/2006
WO WO 01/92687 12/2001
(Continued)

OTHER PUBLICATIONS

International Search Report for PCT/GB2010/002196, Dec. 2011, 5 pgs.
(Continued)

*Primary Examiner* — Kenneth L Thompson
*Assistant Examiner* — Michael Wills, III
(74) *Attorney, Agent, or Firm* — Faegre Baker Daniels LLP

(57) ABSTRACT

An apparatus and method for forming a plug in a passageway, comprises a carrier which in use is lowered into the passageway, the carrier comprising an elongate body of material resistant to creep which supports first and second spaced apart portions and a body of material supported on the carrier, the material having a melting point which is higher than the temperature within the passageway and which expands as it solidifies. The carrier may comprise a skirt that extends axially from a lower end of the carrier, the skirt being dimensioned to define a clearance between the skirt and the passageway; and a heater for melting the body of material such that melted material fills a space defined between the first and second portions, and flows into the clearance defined between the skirt and the passageway. The heater may be a removable heater.

24 Claims, 3 Drawing Sheets

(51) Int. Cl.
*E21B 33/12* (2006.01)
*E21B 33/134* (2006.01)

(56) References Cited

U.S. PATENT DOCUMENTS

| | | | | |
|---|---|---|---|---|
| 2,298,129 | A | 10/1942 | Irons | |
| 2,363,269 | A | 11/1944 | Schlumberger | |
| 2,942,668 | A | 11/1944 | Maly | |
| 3,208,530 | A | 9/1965 | Allen et al. | |
| 3,273,641 | A | 9/1966 | Bourne | |
| 3,333,635 | A | 8/1967 | Crawford | |
| 3,419,074 | A | 12/1968 | Brown | |
| 3,420,928 | A | 1/1969 | Brown | |
| 3,474,414 | A | 10/1969 | Lenz | |
| 3,476,963 | A | 11/1969 | Feldhoff et al. | |
| 3,578,084 | A | 5/1971 | Bombardleri et al. | |
| 3,738,424 | A | 6/1973 | Osmun et al. | |
| 3,765,486 | A | 10/1973 | Matthews et al. | |
| 3,891,034 | A | 6/1975 | Owen et al. | |
| 4,024,916 | A | 5/1977 | Hartley et al. | |
| 4,134,452 | A | 1/1979 | Kingelin | |
| 4,275,788 | A | 6/1981 | Sweatman | |
| 4,484,750 | A | 11/1984 | Scruggs | |
| 4,487,432 | A | 12/1984 | Passerell et al. | |
| 4,489,784 | A | 12/1984 | Messenger | |
| 4,873,895 | A | 10/1989 | Taylor et al. | |
| 5,137,283 | A | 8/1992 | Giarrusso et al. | |
| 5,607,017 | A | 3/1997 | Owens et al. | |
| 5,621,844 | A | 4/1997 | Bridges | |
| 6,384,389 | B1 | 5/2002 | Spencer | |
| 6,474,414 | B1 | 11/2002 | Gonzalez | |
| 6,664,522 | B2 | 12/2003 | Spencer | |
| 6,769,483 | B2 | 8/2004 | de Rouffignac et al. | |
| 6,828,531 | B2 | 12/2004 | Spencer | |
| 6,923,263 | B2 * | 8/2005 | Eden et al. | 166/288 |
| 6,942,032 | B2 | 9/2005 | Spencer | |
| 7,152,657 | B2 | 12/2006 | Bosma et al. | |
| 7,449,664 | B2 | 11/2008 | Spencer | |
| 7,640,965 | B2 | 1/2010 | Bosma | |
| 2005/0199307 | A1 * | 9/2005 | Eden | 138/89 |
| 2006/0144591 | A1 * | 7/2006 | Gonzalez et al. | 166/277 |
| 2010/0155085 | A1 | 6/2010 | Spencer | |

FOREIGN PATENT DOCUMENTS

| | | |
|---|---|---|
| WO | WO 02/27137 | 4/2002 |
| WO | WO 03/083255 | 10/2003 |

OTHER PUBLICATIONS

Written Opinion of the International Searching Authority for PCT/GB2010/002196, Jun. 2012, 9 pgs.
European Search Report for EP Application No. EP 14 19 8354, issued Mar. 10, 2015.

* cited by examiner

SEALING METHOD AND APPARATUS

CROSS-REFERENCE TO RELATED APPLICATION

This application is a nationalization of PCT Patent Application Serial No. PCT/GB2010/002196, filed Dec. 1, 2010, which claims the benefit of Canadian Application No. 2688635 filed on Dec. 15, 2009 and Canadian Application No. 2688704, filed Dec. 15, 2009, the disclosures of which are expressly incorporated herein by reference

TECHNICAL FIELD

The present invention relates to a method and apparatus for plugging a passageway. Such passageways include underground components which may be plugged to prevent leakage of hydrocarbon fluids from those components.

BACKGROUND

The known plugs tend to leak for a variety of reasons. Firstly, as the well wall is typically not particularly clean and is also covered with a hydrocarbon film, it is difficult to produce a reliable contiguous seal. Often a contiguous seal of only a meter or so in length is formed with a plug fifty times that length. Furthermore, as cement and resin based plugs solidify they contract which tends to open up a gap between the plug and the well wall. Although when a plug is initially inserted there may be little dynamic pressure in the well, after the plug is in situ substantial pressures can build up and as a result a plug which appears initially to be working satisfactory may subsequently be found to leak. If hydrocarbons leak past the plug contamination of the surface environment or for example a sub-surface aquifer can result. It is well known in the industry that a significant proportion of abandoned wells leak. As a result leaking abandoned wells often have to be re-plugged which is an expensive and time consuming operation.

It is an object of the present invention to provide an improvement to existing methods and apparatus for sealing such structures.

SUMMARY

According to the present invention there is provided an apparatus for forming a plug in a passageway, the apparatus comprising a carrier which in use is lowered into the passageway, the carrier comprising an elongate body of a material resistant to creep which supports first and second spaced apart portions and a body of material supported on the carrier, said material having a melting point which is higher than the temperature within the passageway and which expands as it solidifies. The carrier may comprise a skirt that extends axially from a lower end of the carrier, the skirt being dimensioned to define a clearance between the skirt and the passageway; and means for melting the body of material such that melted material fills a space defined between the first and second portions, and flows into the clearance defined between the skirt and the passageway. The apparatus may comprise a removable heater operative to melt the body of material such that melted material fills a space defined between the first and second portions.

According to a first aspect of the present invention there is provided an apparatus for forming a plug in a passageway, the apparatus comprising i. a carrier which in use is lowered into the passageway, the carrier comprising an elongate body of a material resistant to creep which supports first and second spaced apart portions and a skirt that extends axially from a lower end of the carrier, the skirt being dimensioned to define a clearance between the skirt and the passageway;

ii. a body of material supported on the carrier, said material having a melting point which is higher than the temperature within the passageway and which expands as it solidifies; and iii. means for melting the body of material such that melted material fills a space defined between the first and second portions, and flows into the clearance defined between the skirt and the passageway.

The first and/or related aspects of the present invention provides a means by which a spacer in the form of a skirt extending from the bottom of the carrier defines a clearance between the skirt and the wall of the well casing for receipt of molten material which can then rapidly cool, solidify and expand to block further flow through the clearance. In doing so, the solidified material around the skirt supports the body of molten material round the carrier above the skirt while it cools and solidifies to thereby enhance the overall integrity of the well plug. It was previously thought that to provide an effective seal the apparatus used to plug a well would need to incorporate a downwardly depending "packer" dimensioned so as to be a tight fit within the well bore.

Surprisingly, however, the devisor(s) of the present invention have determined that such an arrangement is not in fact always required. While not wishing to be bound by any particular theorem, it is currently thought that by replacing the tight-fitting packer with a skirt that is a loose fit within the passageway and an appropriate type of meltable material that, once melted, can flow into the gap between the skirt and the inner wall of the passageway, and then rapidly lose heat to its surroundings (e.g. water within the well and/or the material of the skirt) the material within the gap can cool and solidify sufficiently rapidly to occupy the gap and thereby form a tight seal around the skirt. As such, the apparatus of the present invention provides a "packerless" means of deploying a sealing plug within a passageway. This affords a number of advantages over prior art systems incorporating a packer, including easier deployment, wider manufacturing tolerances since a close conformity between the size of the skirt and the passageway is no longer required, and greater flexibility in the range of applications in which apparatus of a single size can be employed, all of which reduce the costs associated with plug deployment.

Once the apparatus has been deployed within the passageway it will typically be submerged in water already resident within passageway, often to a very significant depth of, for example, around 300 to 400 m. Such depths of water provide a hydrostatic pressure of 3 to 4 MPa which is sufficient to prevent the water adjacent the hot molten material from being able to boil. Again without wishing to be bound by any particular theorem it is currently believed that the water, by virtue of having such a high specific heat capacity (around 4.2 $J/cm^3$ K at 25° C.), contributes significantly to the rapid cooling of the melted material within the gap around the skirt, and that the melted material within the gap contacting the cooling water exhibits flow behaviour akin to the pahoehoe flow behaviour exhibited by certain types of lava flows. As a result, the solidified material quickly forms a strong and reliable seal around the skirt of the apparatus which can support the body of molten material around the carrier which will in turn cool, solidify and expand to provide an effective seal.

With regard to the first and related aspects of the present invention it is preferred that the spaced apart portions are dimensioned to define respective gaps between said portions and the passageway, means being provided to obstruct said gaps formed between the portions and the passageway, the obstructing means being displaced into the gaps as a result of melting of the body of material or as a result of creep of material after it has been melted and solidified.

The spaced apart portions may be defined by fins extending radially outwards from the elongate body.

The skirt may be hollow. The skirt may be tubular and defines an opening at its lower end. The skirt is preferably dimensioned to define an annular clearance between the skirt and the passageway. The diameter of the skirt is preferably at least around 50% of the inner diameter of the passageway, at least around 60% of the inner diameter of the passageway, or around 75 to 90% of the inner diameter of the passageway.

The skirt may be formed from a material selected from the group consisting of cement, fibre reinforced cement, concrete, fibre reinforced concrete, rubber and plastic. The skirt may be cast or moulded on to a supporting member attached to the lower end of the carrier. The skirt may be attached to the lower end of the carrier by an adhesive and/or suitable fixing.

Preferably the means for melting the body of material is a removable heater operative to melt said body of material. The heater may be releasably connected to the elongate body of the carrier. The connection between the heater and the elongate body is preferably breakable upon heating. The connection between the heater and the elongate body may comprise a material having a melting point that is higher than the melting point of the body of meltable material initially supported on the carrier. It is preferred that the material comprised in the releasable connection has a melting point that is around 10 to 50° C. higher than the melting point of the body of meltable material initially supported on the carrier. The connection between the heater and the elongate body may comprise a solder.

The elongate body preferably defines an interior space and the heater may be removably received within said space. The elongate body is preferably tubular.

A data logger may be associated with the heater to record data relating to the operation of the heater.

One or more sensors may be associated with the apparatus to detect the temperature of a component of the apparatus and/or an area of the passageway adjacent to the apparatus before, during and/or after operation of the heater.

The heater may be removable from the apparatus after operation to allow a coolant to access the apparatus and cool the melted material. Removal of the heater from the apparatus preferably defines a space into which coolant can rapidly flow to cause rapid cooling of the melted material. The coolant may be water.

It is preferable that the heater is arranged so that the apparatus can be suspended within the passageway via the heater during deployment of the apparatus.

The heater may be connected to a power source located outside the passageway.

Preferably the heater is an electric heater or a gasless pyrotechnic heating element.

The passageway may be a well.

The invention further provides a method for forming a plug in a passageway, wherein the method comprises i. placing a carrier in the passageway, the carrier defining an elongate body of material resistant to creep which supports at least two spaced apart portions and a skirt that extends axially from a lower end of the carrier, the skirt being dimensioned to define a clearance between the skirt and the passageway;

ii. melting in the passageway a body of material the melting point of which is higher than the temperature within the passageway and which expands as it solidifies such that melted material fills a space defined between the spaced apart portions and flows into the clearance defined between the skirt and the passageway; and iii. causing and/or allowing the melted material in the clearance to rapidly cool and solidify.

The method preferably further comprises cooling the carrier such that molten material adjacent the spaced apart portions solidifies before molten material between the spaced apart portions that is spaced from the carrier.

The carrier may comprise an elongate tubular body from which the spaced apart portions project, and the carrier is cooled by introducing coolant into the tubular body. Melting of the body of material is preferably effected by operating a heater in the passageway. The method preferably further comprises removing the heater from the passageway. The heater may be removed from the passageway before, during or after the melted material cools and solidifies. Removal of the heater from the passageway may be facilitated by breaking a connection between the heater and the elongate body of the carrier. Said connection may be broken by heating. It is preferred that the heater is operated to melt the meltable material initially supported on the carrier at a first temperature and to break the connection between the heater and the elongate body of the carrier at a second higher temperature. A force tending to disconnect the heater from the elongate body of the carrier may be applied to the heater while the heater is operated between the first and second temperatures such that upon reaching the second temperature the heater is disconnected from the elongate body of the carrier.

A data logger associated with the heater may be operated to record data relating to the operation of the heater.

One or more sensors associated with the apparatus may be operated to detect the temperature of a component of the apparatus and/or an area of the passageway adjacent to the apparatus before, during and/or after operation of the heater. Preferably the method further comprises submerging the carrier and associated skirt within a liquid within the passageway. Said liquid may be water.

The passageway may be a well.

According to a second aspect of the present invention there is provided an apparatus for forming a plug in a passageway, the apparatus comprising i. a carrier which in use is lowered into the passageway, the carrier comprising an elongate body of a material resistant to creep which supports first and second spaced apart portions that are a sliding fit in the passageway;

ii. a body of material supported on the carrier, said material having a melting point which is higher than the temperature within the passageway and which expands as it solidifies; and iii. a removable heater operative to melt the body of material such that melted material fills a space defined between the first and second portions.

The spaced apart portions may be dimensioned to define respective gaps between said portions and the passageway, means being provided to obstruct said gaps formed between the portions and the passageway, the obstructing means being displaced into the gaps as a result of melting of the body of material or as a result of creep of material after it has been melted and solidified. The spaced apart portions may be defined by fins extending radially outwards from the elongate body.

Preferably the heater is releasably connected to the elongate body of the carrier. The connection between the heater and the elongate body may be breakable upon heating. The connection between the heater and the elongate body preferably comprises a material having a melting point that is higher than the melting point of the body of meltable material initially supported on the carrier. The material comprised in the releasable connection may have a melting point that is around 10 to 50° C. higher than the melting point of the body of meltable material initially supported on the carrier. The connection between the heater and the elongate body preferably comprises a solder.

The elongate body may define an interior space and the heater is removably received within said space. The elongate body may be tubular.

A data logger may be associated with the heater to record data relating to the operation of the heater.

One or more sensors may be associated with the apparatus to detect the temperature of a component of the apparatus and/or an area of the passageway adjacent to the apparatus before, during and/or after operation of the heater.

It is preferred that the heater is removable from the apparatus after operation to allow a coolant to access the apparatus and cool the melted material. Removal of the heater from the apparatus preferably defines a space into which coolant can rapidly flow to cause rapid cooling of the melted material. The coolant may be water.

It is preferred that the heater is arranged so that the apparatus can be suspended within the passageway via the heater during deployment of the apparatus.

The heater may be connected to a power source located outside the passageway.

The heater may be an electric heater or a gasless pyrotechnic heating element.

The invention further provides a method for forming a plug in a passageway, wherein the method comprises i. placing a carrier in the passageway, the carrier defining an elongate body of material resistant to creep which supports at least two spaced apart portions that are a sliding fit in the passageway;
ii. operating a heater in the passageway to melt a body of material the melting point of which is higher than the temperature within the passageway and which expands as it solidifies such that melted material fills a space defined between the spaced apart portions;
iii. removing the heater from the passageway; and
iv. causing and/or allowing the melted material in the space to cool and solidify.

Preferably the method further comprises cooling the carrier such that molten material adjacent the spaced apart portions solidifies before molten material between the spaced apart portions that is spaced from the carrier.

The carrier may comprise an elongate tubular body from which the spaced apart portions project, and the carrier may be cooled by introducing coolant into the tubular body.

The heater may be removed from the passageway before, during or after the melted material cools and solidifies.

Preferably removal of the heater from the passageway is facilitated by breaking a connection between the heater and the elongate body of the carrier. Said connection may be broken by heating. It is preferred that the heater is operated to melt the meltable material initially supported on the carrier at a first temperature and to break the connection between the heater and the elongate body of the carrier at a second higher temperature. A force tending to disconnect the heater from the elongate body of the carrier may be applied to the heater while the heater is operated between the first and second temperatures such that upon reaching the second temperature the heater is disconnected from the elongate body of the carrier.

A data logger associated with the heater may be operated to record data relating to the operation of the heater.

One or more sensors associated with the apparatus may be operated to detect the temperature of a component of the apparatus and/or an area of the passageway adjacent to the apparatus before, during and/or after operation of the heater.

In a further aspect the present invention provides a method for forming a plug in a passageway, wherein the method comprises i. placing a carrier in the passageway, the carrier defining an elongate body of material resistant to creep which supports at least two spaced apart portions that are a sliding fit in the passageway;
ii. operating a heater in the passageway to melt a body of material the melting point of which is higher than the temperature within the passageway and which expands as it solidifies such that melted material fills a space defined between the spaced apart portions;
iii. further operating the heater to break a connection between the heater and the elongate body of the carrier by heating said connection to a temperature that is higher than the melting point of the meltable material;
iv. removing the heater from the passageway; and
v. causing and/or allowing the melted material in the space to cool and solidify.

The second and/or related aspects of the present invention provides a convenient and cost-effective means by which a strong and reliable plug can be formed to seal a passageway by melting a body of a suitable material and then recovering the heater used to melt the plug material. This not only provides a cost benefit since the heater can be reused but also facilitates various means by which the sealing process can be monitored and/or the integrity of the seal determined as described in more detail below.

The method preferably comprises submerging the carrier within a liquid within the passageway. Said liquid may be water.

BRIEF DESCRIPTION OF THE FIGURES

Embodiments of the present invention will now be described, by way of example, with reference to the accompanying drawings, in which.

DETAILED DESCRIPTION

FIGS. 1 to 6 show an assembly according to the invention which can be used to form a bismuth alloy plug within a wall casing 1. A solid bismuth alloy plug is formed from an amount of bismuth alloy delivered in solid form on a carrier spool to the required depth within the casing 1.

Figure 7:
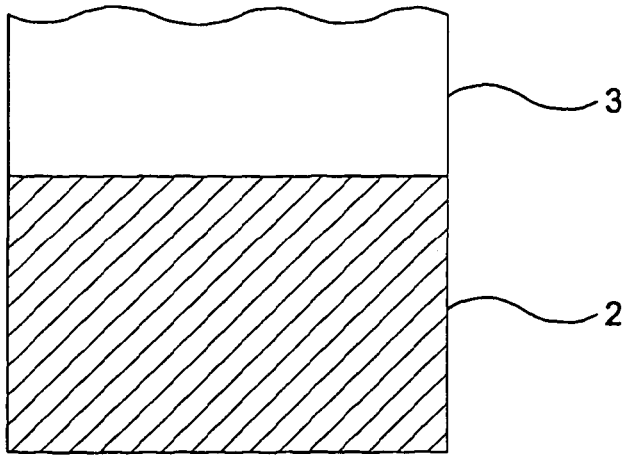
FIG. 7 illustrates a cross-sectional view of a similar part of an assembly as shown in FIG. 6 but in which the assembly is in accordance with an alternative preferred embodiment of the present invention.

The carrier spool may comprise 1% manganese steel and is therefore resistant to elongation as a result of creep. The carrier spool comprises a cylindrical skirt 2 connected to a tubular mandrel 3. In the embodiment shown in FIGS. 1 to 3, and 5 to 6, the skirt 2 is formed of concrete cast on to an inverted T-bar 4 (visible in FIG. 6) secured to a lower end 5 of the mandrel 3. A single T-bar 4 is shown which is connected to the centre of the lower end 5 of the mandrel 3, but it will be appreciated that two or more such T-bars, or any other form of mounting point, could be used to support the cast concrete skirt 2. Moreover, the skirt 2 could be produced from any other suitable tough volume-filling material, such as cement (optionally with fibre reinforcement), or a plastic material which is then attached to the lower end 5 of the mandrel 3 using an adhesive 6 or some other form of fixing, such as a rivet, bolt, screw or the like, passing through a portion of the skirt 2 and the mandrel 3 as depicted in FIG. 7. The skirt 2 can be formed of any appropriate material provided it can withstand the conditions to which it will be exposed during and after deployment. By way of further example, the skirt 2 could be made from steel or a suitable rubber-based material.

In the particular embodiment depicted in FIGS. 1 to 3 and 5 to 6, the lower end 5 of the mandrel 3 incorporates a frustoconical head 7, from which the cylindrical skirt 2 extends axially downwards so as to define a skirt region, the purpose of which will be described in more detail below. The head 7 does not have to be frustoconical, however, and may in fact take any convenient form such as a flat radially extending flange, or be completely omitted such that the skirt 2 extends directly from the lower end 5 of the mandrel 3, with the upper end of the skirt 2 presenting a step extending radially outwards from the mandrel 3.

The mandrel 3 has a plurality of circular flanges defining fins 8 distributed at intervals along its length. The mandrel 3 also has an upper open end 9. In the embodiment depicted in FIGS. 1 to 3 and 5 to 6, the diameter of each fin 8 is approximately equal to the diameter of the base of the head 7 and the skirt 2. In alternative embodiments including a head 7 the diameter of the head 7 may be larger or smaller than that of the fins 8 provided the head 7 is still suitably dimensioned to enable it to be slid down the casing 1 and to provide the required spacing between mandrel 3 and any liquids (e.g. water) in the well, and between the edge of the skirt 2 and the well casing 1, for reasons discussed more fully below. In embodiments not including a head 7, the skirt 2 may again have a similar diameter to the fins 8, or a larger or smaller diameter. By way of example and with reference to FIG. 7, the head 7 is omitted and the skirt 2 has a diameter which is approximately the same as the mandrel 3, such that the skirt 2 extends axially downwards from the lower end 5 of the mandrel 3 so as to define a substantially continuous curved peripheral surface made up of the lower portion of the mandrel 3 and the skirt 2.

In delivery form (shown in FIG. 3), a body of material 12 in the form of a metal to be melted to form a plug locates along the length of the mandrel 3 between the head 7 and an upper fin 8, defining a cylinder extending as far as the peripheral edge of the upper fin 8. The metal may comprise, for example, pure bismuth, an admixture of 95% bismuth and 5% tin, or an admixture of 52% bismuth and 48% tin. In each case the metal may be doped with sodium. In this form the carrier spool is inserted into the casing 1 (skirt end first} and lowered to the required depth.

Figure 4A:
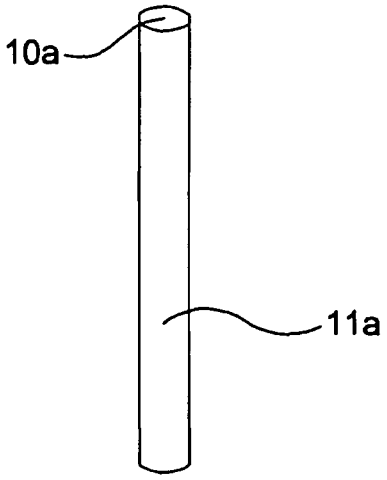
FIG. 4*a* illustrates a first embodiment of a component of the assembly depicted in FIGS. 1 to 3 such that the assembly is in accordance with the first aspect of the present invention.

The bismuth alloy is melted in situ by a heater which normally locates within the mandrel 3 (but which is illustrated for clarity in FIG. 4*a* outside the mandrel 3). The embodiment of the heater shown in FIG. 4*a* defines a cylinder, an upper portion of which comprises an ignition source 10*a* and a lower portion of which comprises a heater element 11*a*. The heater element 11*a* may comprise an admixture of aluminium and iron oxide (a thermite mixture). The ignition source 10*a* may comprise a barium peroxide fuse, an electrical heater or an electrical match. It will be appreciated that other forms of both ignition source 10*a* and heater element 11*a* could be used. For example, the ignition source 10*a* and heater element 11*a* may be completely replaced with a suitable electric heater (not shown) located within the mandrel 3, or an intermetallic gasless pyrotechnic heat source, such as a nickel-aluminium powder admixture.

Activation of the ignition source 10*a* triggers the heater element 11*a*. Heat produced from the heater element 11*a* causes the bismuth alloy supported on the mandrel 3 to become molten.

Figure 4B:
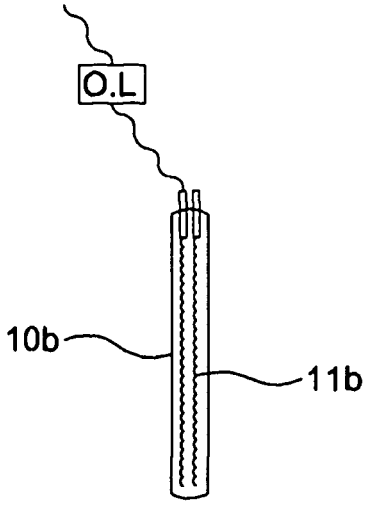
FIG. 4*b* illustrates a second embodiment of a component of the assembly depicted in FIGS. 1 to 3 such that the assembly is in accordance with the second aspect of the present invention.
Figure 5:
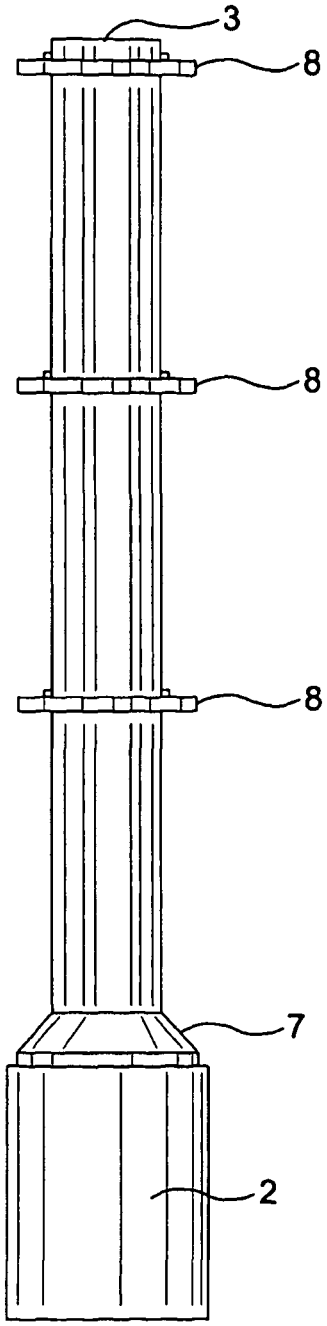
FIG. 5 further illustrates the assembly depicted in FIGS. 1 to 3.
Figure 6:
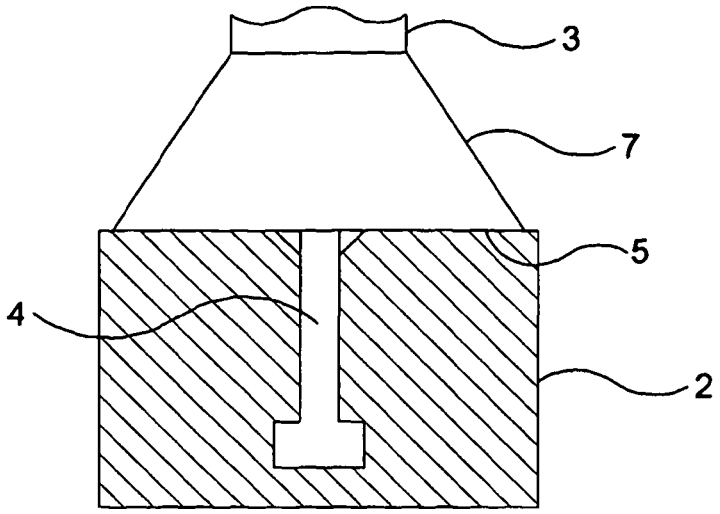
FIG. 6 illustrates a cross-sectional view of part of the assembly of FIGS. 1 to 5.

In the alternative embodiment shown in FIG. 4*b* the bismuth alloy is melted in situ by an electric heater which is removably received within the mandrel 3 (but which is illustrated for clarity in FIG. 4*b* outside the mandrel 3). The heater comprises a cylindrical housing 10*b* within which is disposed a pair of electrical heating elements 11*b*. The exact size, shape, number and power rating of the heating elements 11*b* can be chosen to suit a particular application provided they are capable of producing sufficient heat to melt the meltable material supported on the mandrel 3. In an alternative embodiment, an intermetallic gasless pyrotechnic heater may be used incorporating, for example, a nickel-aluminium powder admixture.

The heater housing 10*b* is fixed to the inside surface of the mandrel 3 by a solder (not shown) which has a higher melting point than the meltable material supported by the mandrel 3. In this way, the heater can be safely used to melt the material intended to form the plug and then released from the inside of the mandrel 3 after deployment of the plug by turning up the heater, or more simply by allowing the heater to continue to heat the assembly above the melting point of the bismuth alloy, so that it raises the temperature of the solder to its melting point thereby causing it to melt and allow the heater to be removed from the mandrel 3 and, in turn, the passageway. As well as allowing the heater to be reused, a further advantage of attaching the heater to the mandrel 3 using solder is that this arrangement provides a high degree of dimensional tolerance as between the heater and the mandrel 3 thereby making fabrication of the apparatus easier and cheaper than if a tight fitting heater is required.

The materials from which the plug and solder are formed must be selected to ensure that there is sufficient difference in their melting point for safe and reliable operation of the apparatus. That is, the melting point of the solder must be sufficiently higher than the plug material to ensure that the plug material has melted before the solder begins to melt since otherwise the heater may disconnect from the mandrel 3 before the plug material has melted sufficiently to fill the spaces between the fins 8 and around the skirt 2. It will also be appreciated that the difference in melting points between the solder and the plug material must be sufficiently great to accommodate the fact that the solder is physically closer to the heating elements 11*b* than the plug material. In a preferred embodiment employing a bismuth alloy plug material with a melting temperature of 139° C. a difference in temperature between the solder and the plug material of around 10 to 50° C., more preferably around 20 to 40° C. has been found to be adequate. Thus, in this embodiment, it is preferred that the solder temporarily attaching the heater to the mandrel 3 has a melting point of around 150 to 190° C. more preferably around 160 to 180° C. The operation of the apparatus is now described in more detail.

Initial operation of the heating elements 11*b* produces sufficient heat to cause the bismuth alloy supported on the mandrel 3 to become molten.

Figure 1:
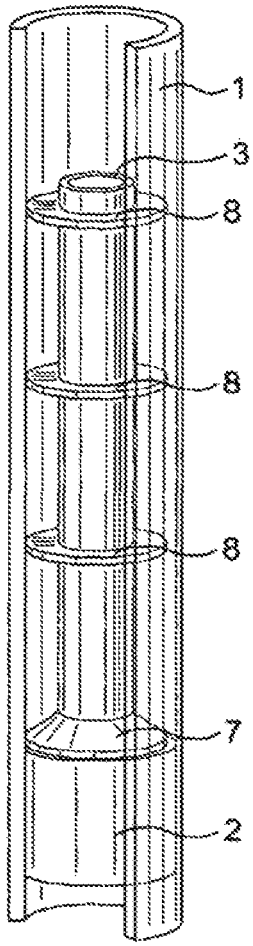
FIGS. 1 to 3 illustrate an assembly for forming a plug in a well in accordance with a first preferred embodiment of the present invention.
Figure 2:
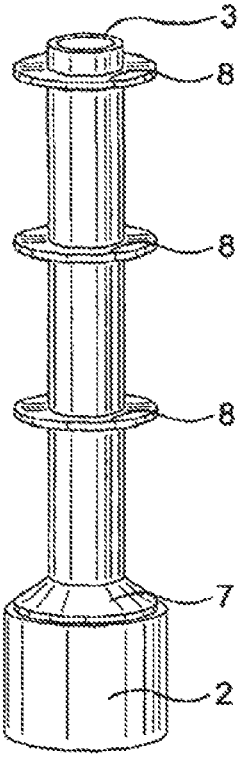

The molten bismuth alloy slumps into a volume defined by the mandrel 3, the fins 8, the upper surface of the head 7, the peripheral surface of the skirt 2 and the casing wall 1 (as shown in FIG. 1). It has been established that the strength and integrity of the seal can be enhanced by providing the skirt 2 with suitable dimensions that allow a small amount of the molten bismuth to slump down passed the head 7 so as to reside, and then rapidly cool, within the gap defined between the peripheral surface of the skirt 2 and the casing wall 1 by rapid heat transfer from the molten bismuth alloy to the surroundings (primarily any water resident within the well bore). For this to be achieved, the skirt 2 should have a diameter that is smaller than that of the well casing 1 so as to define a peripheral gap extending around the edge of the skirt 2, and the skirt 2 should also be of a sufficient axial length so that the molten bismuth alloy can slump sufficiently far from the heated mandrel 3 to rapidly cool and solidify within the gap rather than slumping passed the lower end of the skirt 2 and out of the volume resulting in an ineffective seal. That being said, a balance needs to be achieved between the cost of the bismuth alloy which is intended to slump into the gap between the skirt 2 and the well casing 1 and the integrity of the seal that is to be formed. It is clearly necessary to provide sufficient bismuth alloy so that the volume of material which slumps into the gap is sufficient to form a reliable seal around the lower end of the assembly, but given the cost of the alloy, it would be uneconomic to use too much of the material. As such, an optimum size of skirt 2 should be selected for a particular well which will define a gap for molten alloy of sufficient volume to enable a reliable seal to be formed at reasonable cost.

As compared to the diameter of the fins 8, the skirt 2 may have a diameter which is around 50 to 120% of the diameter of the fins 8, provided, of course, that both the fins 8 and skirt 2 are small enough to allow the assembly to be passed down the well. The skirt 2 may have a diameter that is around approximately equal to that of the mandrel 3 (as shown in FIG. 7), or may have a diameter which is larger, for example, around 50 to 100% larger, than the diameter of the mandrel 3. The diameter of the skirt 2 may be at least around 50% of the inner diameter of the well casing 1 at the level the well is to be sealed, but may be at least around 60% or around 75 to 90% of the inner diameter of the well casing 1 so as to ensure that the radial dimension of the volume defined between the skirt 2 and the well casing 1 is large enough to accommodate expansion of the molten alloy as it cools and a sufficient volume of molten material to provide a seal with the required strength, but not so large as to waste costly material or to cause unequal cooling to occur across the radial dimension of the volume of molten alloy resulting in the volume possessing a heterogeneous structure and thereby providing an unreliable seal. By way of example, tests have determined that a strong and reliable seal can be formed in the manner described above using apparatus incorporating a tubular skirt having an outer diameter of around 7.5 cm (3 inches) in a cylindrical passageway similar to a conventional well bore having an inner diameter of around 11.5 cm (4.5 inches) and which therefore defines an annular clearance of around 2 cm (0.75 inches) between the skirt and the passageway for receipt of the molten bismuth alloy.

Figure 3:
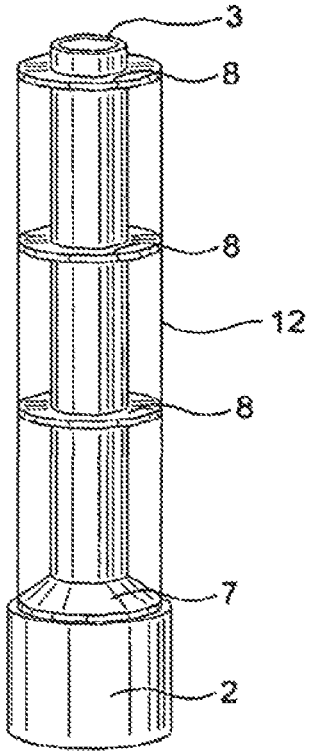

With regard to the axial length of the skirt 2, this also defines the volume and therefore the cost of the alloy that will reside within the gap between the skirt 2 and the well casing 1. A longer skirt 2 provides a greater volume to facilitate effective cooling of the alloy before it slumps passed the bottom of the assembly and thereby ensure an effective seal is formed around the skirt 2. A longer skirt 2, however, also defines a larger volume for receipt of more molten alloy, which increases material costs. One way in which the skirt length can be defined is in relation to the overall length of the mandrel 3 since the length of the mandrel 3 typically defines the total volume of alloy material which is initially supported on the assembly before deployment (as shown in FIG. 3) and which can therefore be used to form the seal. The skirt 2 may be at least around 10 to 20% of the total length of the mandrel 3, or may be longer, such as at least around 30 to 40% of the total length of the mandrel 3.

Commonly, wells to be sealed contain a liquid, such as water. This is advantageous since this water can be used to cool the molten bismuth alloy as it slumps into the gap between the skirt 2 and the well casing 1. If the water level is not at the optimum sealing level then further water can be introduced into the well so as to raise the water level to an appropriate level to assist in forming the seal at the optimum level. As the molten bismuth alloy slumps into the gap at the lower end of the assembly around the outside of the skirt 2 it contacts the water within the well and rapidly forms a solidified skin, in a similar way to that which occurs in undersea volcanic lava flows, exhibiting pahoehoe flow. The skin may initially re-melt or deform, but has sufficient structural integrity after a very short period of time to prevent rapid mass flow, and will rapidly solidify as cooling of the alloy continues until such time as a strong and reliable lower crust is formed. The underside of the solidified alloy contacting the water within the well is likely to be irregular but due to the pahoehoe nature of the alloy's flow the layer of alloy above the crust should have a more uniform structure and thereby provide a reliable seal against the wall of the well casing 1, as the remainder of the molten alloy solidifies within the volume higher up the mandrel 3.

It was previously thought that to provide an effective seal apparatus used to plug a well would need to incorporate a downwardly depending "packer" dimensioned so as to be a tight fit within the well bore. Surprisingly, however, the devisor(s) of the present invention have determined that such an arrangement is not in fact always required. While not wishing to be bound by any particular theorem, it is currently thought that by replacing the tight-fitting packer with a skirt that is a loose fit within the passageway and an appropriate type of meltable material that, once melted, can flow into the gap between the skirt and the inner wall of the passageway, and then rapidly lose heat to its surroundings (e.g. water within the well and/or the material of the skirt) the material within the gap can cool and solidify sufficiently rapidly to occupy the gap and thereby form a tight seal around the skirt. Once the apparatus has been deployed within the passageway it will typically be submerged in water already resident within passageway, often to a very significant depth of, for example, around 300 to 400 m. Such depths of water provide a hydrostatic pressure of 3 to 4 MPa which is sufficient to prevent the water adjacent the hot molten material from being able to boil. Again without wishing to be bound by any particular theorem it is currently believed that the water, by virtue of having such a high specific heat capacity (around 4.2 J/cm3 K at 25° C.), contributes significantly to the rapid cooling of the melted material within the gap around the skirt.

In this way, the above-described apparatus provides a "packerless" means of deploying a sealing plug within a passageway. This affords a number of advantages over prior art systems incorporating a packer, including easier deployment, wider manufacturing tolerances since a close conformity between the size of the skirt and the passageway is no longer required, and greater flexibility in the range of applications in which apparatus of a single size can be employed, all of which reduce the costs associated with plug deployment.

It may be advantageous to use an assembly incorporating a relatively long skirt 2, for example, a skirt 2 that is around 50 to 100% of the length of the mandrel 3 so that the skirt 2, which is generally formed of a relatively cheap material like concrete or plastic, can be submerged into the water within the well to a sufficient depth to ensure that the skirt 2 and the wall of the well casing 1 define an appropriate volume for receipt of the molten alloy taking into account the balance of cost against seal strength described above. Longer skirts 2 may be advantageous since they provide greater flexibility during deployment to ensure that the seal can be formed at the optimum position and at an acceptable cost. Longer skirts 2 also would not typically have a significant bearing on the total cost of the assembly because they are generally produced very cheaply using low cost raw materials, such as cast concrete (as in FIGS. 1 to 6) or moulded plastic (as in FIG. 7}. A further benefit is that a single, or a pre-specified range, of assemblies can be produced in large quantities but that will still suit a wide range of different applications.

The skirt 2 can be solid, for example a solid block of concrete, which may include fibre reinforcement, cast on to one or more supporting members attached to the lower end of the mandrel 3 as shown in FIGS. 1 to 6, or a solid block of plastic adhered to the lower end of the mandrel 3 as shown in FIG. 7. Alternatively, the skirt 2 can be hollow or tubular so as to define an internal cavity for receipt of a coolant, such as water already resident within the well. In this way, the outer wall of the skirt 2 is cooler than if the skirt 2 is a solid block of material, and so in this way, the hollow skirt 2 can increase the rate of cooling of molten material flowing into the space defined between the skirt 2 and the wall of the well casing 1.

In addition to the above, in the embodiment depicted in FIGS. 1 to 6, the frustoconical head 7 is able to serve as a wedge that drives into the expanded bismuth alloy plug and, in doing so, forces the plug against the casing wall 1 improving the integrity of the seal. The seal is further enhanced by the fins 8 which serve three purposes. Firstly the fins 8 aid in forcing the expanding metal against the casing 1 by minimising axial and promoting lateral expansion. Secondly the fins 8 aid the transfer of heat from the heater element 11 to the bismuth alloy. Thirdly the fins 8 aid in reducing creep of the bismuth alloy plug up hole.

The fins 8 are a loose sliding fit within the well casing 1 and therefore relatively small gaps are defined between the casing and the peripheral edges of the fins 8 (and the peripheral edge of the head 7). This gap is generally referred to as the "drift". When the molten metal cools and solidifies, it expands. In the absence of the fins 8, much of this expansion would simply result in molten metal flowing upwards in the axial direction. This would not contribute to the formational of a plug tightly compressed within the casing. The fins 8 reduce this flow, hence improving the security of the plug.

The effect of the fins 8 is increased by introducing a coolant into the carrier body defined by the mandrel 3 after the plug material has been melted. Coolant can be delivered to the mandrel 3 in any convenient manner. For example, simply by ensuring that the casing above the plug is filled with water is generally sufficient providing that the water can penetrate into the mandrel 3 after heating of the plug. Alternatively, a body of coolant can be provided which is released a predetermined period after heating. Introduction of the coolant will cause material adjacent the mandrel 3 to solidify before material further from the mandrel 3, and thereafter cooling will be accelerated around the fins 8. As a result molten material in the gaps between the peripheries of the fins 8 and the casing 1 will solidify relatively rapidly, before a substantial portion of the melted material has a chance to solidify. The material that is still molten at this stage is as a result, effectively trapped between the seal formed around the lower end of the assembly around the skirt 2, the head 7 which is acting like a wedge, and the fins 8. As this trapped material cools and solidifies the resultant expansion contributes to the application of pressure to the casing 1 so as to provide a very tight plug and a reliable seal.

In the embodiment of the present invention in which the heater depicted in FIG. 4*b* is used, during deployment of a plug the heating elements 11*b* are operated across a temperature cycle of a duration dependent upon the type of heater being used and the nature of the plug and solder materials. A relatively low power heater. e.g. a 3.3 kW heater, can be used over a longer period of time, such as up to around 3 to 4 hours for an 11.5 cm (4.5 inch) diameter plug, or alternatively for the same plug dimensions, a higher power heater. e.g. a 10 kW heater, can be used over a shorter period of time, such as up to around ½ to 1 hour.

In this specific embodiment, the operation of the heating elements 11*b* is intended to achieve two primary objectives—melting of the plug material followed by melting of the solder which secures the heater to the mandrel 3 so that the heater can be removed, tested and re-conditioned for reuse. During initial operation of the heating elements 11*b* to melt the plug material the temperature of heating elements 11*b* increases as a result of maintaining a constant heat output to a first temperature which is sufficient to cause the plug material to melt as described above. The temperature of the plug material increases as the heating effect of the heating elements 11*b* increases until such time as it reaches the melting point of the plug material. At this point, the heat output of the heating elements 11*b* is maintained and the temperature of the plug material also remains constant while the plug material undergoes the phase change from solid to liquid. Once the phase change is completed the temperature of the plug material increases again while the heat output of the heating elements 11*b* is maintained. This continues until the solder connecting the heater housing 10*b* to the inside surface of the mandrel 3 reaches its melting point at which point the solder melts thereby releasing the heater from the mandrel 3 and allowing the heater to be removed for testing, servicing and subsequent reuse. It is preferred that the connection of the heater to the mandrel 3 via the solder is sufficiently strong to enable the entire apparatus to be supported via cabling connected to the heater. In this way, the apparatus can be lowered into the passageway and the heater subsequently recovered using a single wire-line operation providing significant benefits in terms of cost and time for deployment. It is further preferred that tension is applied to the cabling from which the apparatus is suspended during operation of the heater so that the heater is withdrawn from the mandrel 3 as soon as possible after the solder melts. This provides an additional benefit in wells filled with water since removal of the heater leaves a space inside the mandrel 3 which momentarily has a lower pressure than the surrounding water. The surrounding water then quickly flows into the space to accelerate the rate of cooling of the mandrel 3 and the associated fins 8. This rapidly quenches the melted plug material starting from the material adjacent to the mandrel 3 and fins 8 to the wall of the well casing 1. Still molten material in between the fins 8 is then vertically trapped between the areas of the material which have now solidified such that as the remaining molten material cools and solidifies it can only expand radially outwardly and thereby enhance the strength and integrity of the seal. Another advantage of this arrangement is that it enables the strength of the plug to be checked by the applied tension during the period between melting of the plug material and melting of the solder. While the temperature of the solder remains below its melting point, if the tension applied to the cabling is insufficient to withdraw the apparatus from the well then this can be used to confirm that the plug is secure around the skirt 2.

At the point at which the solder melts and before the heater is released a rapid elevation in the temperature of the heating elements 11*b* is observed. This elevation in temperature can be detected by a sensor located on or adjacent to the heater and used to control disconnection of power to the heater to save cost and prevent the heater and the surroundings from overheating. The temperature behaviour of the heating elements 11*b* during operation of the heater can be captured by a data logger D.L. connected to the heater, as shown schematically in FIG. 4, so that the performance of the heater can be interrogated and verified after deployment either on- or off-site. In this way, a detailed understanding of the temperature changes occurring during operation of the heater can be used to check that the deployment of the plug has been carried out to a satisfactory standard to provide a strong and reliable plug.

Once the plug has been formed, the fins 8 offer substantial resistance to creep of the plug material past the fins 8 given the relatively narrow gaps around the peripheral edges of the fins 8. This gap can be further reduced in magnitude by arranging for it to be obstructed by devices which are embedded in the plug. For example grooves in the peripheral edges of the fins 8 may receive a double-turn ring of a memory metal such that when heated as a result of melting of the plug material the ring springs outwards so as to obstruct the gap between the peripheral edge of the fins 8 and the casing 1. Alternatively, the double turn ring can be replaced with a C-shaped ring formed of a memory metal simply pre-sprung but initially restrained so as to be held within the groove around the periphery of each fin 8, the spring being released as a result of heating of the assembly. The body of material located between the fins 8 could have embedded within it particulates such as balls which will move into the gaps adjacent the fins 8 when the material is melted. For example, "floating" balls of steel or aluminium and "sinking" balls of, for example, tungsten so that when the material is melted the floating balls move upwards adjacent the upper fin 8 and the sinking balls sink downwards adjacent the lower fin 8. The axially facing surfaces of the fins 8 could be frustoconical to encourage migration of the balls into the gaps adjacent the peripheral edges of the fins 8. It would be possible in some applications to rely upon magnetism, for example by embedding magnetised particles within the material to be melted, the magnetised particles migrating towards the gaps around the peripheral edges of the fins 8 as soon as the material is melted. It would also be possible to use magnetism in other ways to displace gap-obstructing components. For example, magnetic C-rings could be constrained in a position such that, after melting of the plug material and consequent release of the constraint, the C-rings are displaced into a position in which they obstruct the gaps. In one arrangement in which the carrier is non-magnetic, C-shaped horseshoe magnets could be positioned such that each extends around 120° of the edge of a fin 8, the magnets being arranged end to end with opposed polarities and embedded in the plug material adjacent the fin 8. When the plug material melts, the rings will be pushed apart by repulsive magnetic forces. Arms could be pivotally mounted on the mandrel 3 at points spaced at an interval of 120°, each of the arms supporting a blocking member which is moveable outwards towards the periphery of an adjacent fin 8, the blocking member being dimensioned and located so that when brought to a position adjacent the fin 8 it blocks approximately ⅓ of the circumference of the gap around the periphery of that fin 8.

Each of the fins 8 could support a peripheral skirt extending in the axial direction from the outer edge of the fin. That peripheral skirt would be embedded in the plug after it has solidified. Creep of the plug material towards the gap around the fin 8 would carry the skirt with it, causing the skirt to flare outwards, thereby blocking the gap.

It will be appreciated that the formation of a plug as described above has a wide range of applications, such as sealing passageways in nuclear waste containers or securing objects, such as cables, components of bridges or the like, to carriers anchored to a solid base such as a rock.

The invention claimed is:

1. An apparatus for forming a plug in a passageway, the apparatus comprising:

a. a carrier which in use is lowered into the passageway, the carrier comprising a mandrel resistant to creep which supports first and second spaced apart portions and a skirt that extends axially from a lower end of the carrier, the skirt being dimensioned to define a clearance between the skirt and the passageway;

b. a body of material supported on the carrier, said body of material having a melting point which is higher than the temperature within the passageway and which expands as it solidifies; and c. means for melting the body of material such that melted material, produced by melting said body of material, fills a space defined between the first and second portions, and flows into the clearance defined between the skirt and the passageway, wherein the means for melting said body of material is a removable heater operative to melt said body of material, the heater being releasably connected to the mandrel of the carrier.

2. An apparatus according to claim 1, wherein the skirt is hollow.

3. An apparatus according to claim 1, wherein the skirt is tubular and defines an opening at its lower end.

4. An apparatus according to claim 3, wherein the skirt is dimensioned to define an annular clearance between the skirt and the passageway.

5. An apparatus according to claim 1, wherein the diameter of the skirt is at least around 50% of the inner diameter of the passageway, at least around 60% of the inner diameter of the passageway, or around 75 to 90% of the inner diameter of the passageway.

6. An apparatus according to claim 1, wherein the connection between the heater and the mandrel is breakable upon heating.

7. An apparatus according to claim 1, wherein the connection between the heater and the mandrel comprises a material having a melting point that is higher than the melting point of the body of meltable material initially supported on the carrier.

8. An apparatus according to claim 1, wherein the heater is arranged so that the apparatus can be suspended within the passageway via the heater during deployment of the apparatus.

9. A method for forming a plug in a passageway, wherein the method comprises:

a. placing a carrier in the passageway, the carrier defining a mandrel resistant to creep which supports at least two spaced apart portions and a skirt that extends axially from a lower end of the carrier, the skirt being dimensioned to define a clearance between the skirt and the passageway;

b. melting in the passageway a body of material the melting point of which is higher than the temperature within the passageway and which expands as it solidifies such that a melted material, produced by melting said body of material, fills a space defined between the spaced apart portions and flows into the clearance defined between the skirt and the passageway; and c. causing and/or allowing the melted material in the clearance to rapidly cool and solidify, wherein melting of the body of material is effected by operating a heater in the passageway and wherein removal of the heater from the passageway is facilitated by breaking a connection between the heater and the mandrel of the carrier.

10. A method according to claim 9, wherein the carrier comprises an elongate tubular body from which the spaced apart portions project, and the carrier is cooled by introducing coolant into the tubular body.

11. A method according to claim 9, wherein the method further comprises removing the heater from the passageway.

12. A method according to claim 9, wherein the heater is removed from the passageway before, during or after the melted material cools and solidifies.

13. A method according to claim 9, wherein said connection is broken by heating.

14. A method according to claim 13, wherein the heater is operated to melt the meltable material initially supported on the carrier at a first temperature and to break the connection between the heater and the mandrel of the carrier at a second higher temperature.

15. An apparatus for forming a plug in a passageway, the apparatus comprising a. a carrier which in use is lowered into the passageway, the carrier comprising a mandrel resistant to creep which supports first and second spaced apart portions that are a sliding fit in the passageway;

b. a body of material supported on the carrier, said material having a melting point which is higher than the temperature within the passageway and which expands as it solidifies; and c. a removable heater operative to melt the body of material such that a melted material, produced by melting said body of material, fills a space defined between the first and second portions, wherein the heater is releasable connected to the mandrel of the carrier.

16. An apparatus according to claim 15, wherein the connection between the heater and the mandrel is breakable upon heating.

17. An apparatus according to claim 15, wherein the connection between the heater and the mandrel comprises a material having a melting point that is higher than the melting point of the body of meltable material initially supported on the carrier.

18. An apparatus according to claim 17, wherein the material comprised in the releasable connection has a melting point that is around 10 to 50° C. higher than the melting point of the body of meltable material initially supported on the carrier.

19. A method for forming a plug in a passageway, wherein the method comprises a. placing a carrier in the passageway, the carrier defining a mandrel resistant to creep which supports at least two spaced apart portions that are a sliding fit in the passageway;

b. operating a heater in the passageway to melt a body of material the melting point of which is higher than the temperature within the passageway and which expands as it solidifies such that a melted material, produced by melting said body of material, fills a space defined between the spaced apart portions;

c. removing the heater from the passageway; and d. causing and/or allowing the melted material in the space to cool and solidify, wherein removal of the heater from the passageway is facilitated by breaking a connection between the heater and the mandrel of the carrier.

20. A method according to claim 19, wherein said connection is broken by heating.

21. A method according to claim 20, wherein the heater is operated to melt the meltable material initially supported on the carrier at a first temperature and to break the connection between the heater and the mandrel of the carrier at a second higher temperature.

22. A method for forming a plug in a passageway, wherein the method comprises a. placing a carrier in the passageway, the carrier defining a mandrel resistant to creep which supports at least two spaced apart portions that are a sliding fit in the passageway;

b. operating a heater in the passageway to melt a body of material the melting point of which is higher than the temperature within the passageway and which expands as it solidifies such that a melted material, produced by melting said body of material, fills a space defined between the spaced apart portions;

c. further operating the heater to break a connection between the heater and the mandrel of the carrier by heating said connection to a temperature that is higher than the melting point of the meltable material;

d. removing the heater from the passageway; and e. causing and/or allowing the melted material in the space to cool and solidify.

23. An apparatus for forming a plug in a passageway, the apparatus comprising:

a. a carrier which in use is lowered into the passageway, the carrier comprising a mandrel resistant to creep which supports first and second spaced apart portions and a skirt that extends axially from a lower end of the carrier, the skirt being dimensioned to define a clearance between the skirt and the passageway;

b. a body of material supported on the carrier, said material having a melting point which is higher than the temperature within the passageway and which expands as it solidifies; and c. means for melting the body of material such that melted material, produced by melting said body of material, fills a space defined between the first and second portions, and flows into the clearance defined between the skirt and the passageway, wherein the skirt is hollow.

24. An apparatus for forming a plug in a passageway, the apparatus comprising:

a. a carrier which in use is lowered into the passageway, the carrier comprising a mandrel resistant to creep which supports first and second spaced apart portions and a skirt that extends axially from a lower end of the carrier, the skirt being dimensioned to define a clearance between the skirt and the passageway;

b. a body of material supported on the carrier, said body of material having a melting point which is higher than the temperature within the passageway and which expands as it solidifies; and c. means for melting the body of material such that melted material, produced by melting said body of material, fills a space defined between the first and second portions, and flows into the clearance defined between the skirt and the passageway, wherein the means for melting the body of material is a removable heater operative to melt said body of material and the heater is arranged so that the apparatus can be suspended within the passageway via the heater during deployment of the apparatus.

* * * * *